United States Patent [19]

Roccaforte

[11] Patent Number: 4,584,202

[45] Date of Patent: Apr. 22, 1986

[54] MICROWAVE POPCORN PACKAGE

[75] Inventor: Harry I. Roccaforte, Western Springs, Ill.

[73] Assignee: Waldorf Corporation, St. Paul, Minn.

[21] Appl. No.: 594,938

[22] Filed: Mar. 29, 1984

[51] Int. Cl.[4] ..... B65D 77/02; B65D 81/34

[52] U.S. Cl. ..... 426/111; 206/608; 206/611; 206/628; 426/107; 426/122; 426/124; 426/113

[58] Field of Search ..... 426/111, 107, 113, 124, 426/234, 122, 123; 206/611, 608

[56] References Cited

U.S. PATENT DOCUMENTS

| | | | |
|---|---|---|---|
| 2,343,222 | 2/1944 | Nelson | 206/608 |
| 2,673,806 | 3/1954 | Colman | 426/111 |
| 2,967,010 | 1/1961 | Cuffey et al. | 206/611 |
| 3,004,697 | 10/1961 | Stone | 206/611 |
| 3,054,680 | 9/1962 | Mennen | 426/111 |
| 3,158,491 | 11/1964 | Farrell et al. | 426/122 |
| 3,298,505 | 1/1967 | Stephenson | 426/123 |
| 3,582,363 | 6/1971 | Jones . | |
| 3,835,280 | 9/1974 | Gades et al. . | |
| 3,973,045 | 8/1976 | Brandberg et al. | 426/110 |
| 4,038,425 | 7/1977 | Brandberg et al. | 426/107 |
| 4,096,948 | 6/1978 | Kuchenbecker | 426/113 |
| 4,228,945 | 10/1980 | Wysocki | 426/113 |
| 4,260,101 | 4/1981 | Webinger | 426/111 |
| 4,279,374 | 7/1981 | Webinger | 426/113 |
| 4,279,933 | 7/1981 | Austin et al. | 426/124 |
| 4,411,365 | 10/1983 | Horikawa et al. | 206/611 |
| 4,419,373 | 12/1983 | Oppermann | 426/111 |
| 4,448,309 | 5/1984 | Roccaforte et al. | 426/107 |
| 4,449,633 | 5/1984 | Johnson et al. | 206/612 |
| 4,450,180 | 5/1984 | Watkins | 426/111 |
| 4,453,665 | 6/1984 | Roccaforte et al. | 426/107 |
| 4,505,391 | 3/1985 | Kuchenbecker | 426/113 |
| 4,525,367 | 6/1985 | Allison | 426/394 |

FOREIGN PATENT DOCUMENTS

| | | | |
|---|---|---|---|
| 1141676 | 1/1969 | United Kingdom | 206/611 |

*Primary Examiner*—Steven Weinstein
*Attorney, Agent, or Firm*—William W. Jones

[57] ABSTRACT

The package allows the popping of popcorn in situ within a pouch contained in a carton. The carton has a tear-away portion in its top panel which is removed when the package is put into the microwave oven. The pouch is folded in the carton so that the edges of the folded pouch are disposed beneath the opening formed by removal of the tear-away portion. The top panel of the carton includes marginal constraining portions bounding the opening which constrain the pouch once the popcorn has commenced popping. The basal portion of the pouch is thus held in the carton while the remainder of the pouch expands through the opening during popping. The carton is provided with feet which elevate the bottom panel of the carton in the microwave oven to minimize scorching of the bottom panel during popping.

5 Claims, 7 Drawing Figures

MICROWAVE POPCORN PACKAGE

This invention relates to an improved package for the microwave popping of popcorn in situ in the package. More particularly, this invention relates to a package which includes a compact stable carton in which is disposed a folded pouch containing popcorn kernels, oils, fats and seasoning, which carton is opened to allow the pouch to expand out of the carton during popping, and which carton includes pouch constraining panels which constrain the pouch to the carton during popping.

The microwave popping of popcorn contained in a pouch or bag which in turn may be disposed in a carton during popping is known in the prior art. For example, U.S. Pat. No. 3,582,363 issued June 1, 1971 to S. A. Jones discloses the microwave popping of popcorn which is contained in an evacuated sealed flexible container. U.S. Pat. Nos. 3,835,280 issued Sept. 10, 1974 to Gades et al and 3,973,045 issued Aug. 3, 1976 to Brandberg et al disclose the microwave popping of popcorn contained in gussetted bags. U.S. Pat. No. 4,038,425 issued July 26, 1977 to Brandberg et al discloses a microwave popcorn package having a container portion and an expandable bag portion. U.S. Pat. Nos. 4,260,101 issued Apr. 7, 1981 to G. P. Webinger and 4,279,933 issued July 21, 1981 to J. J. Austin et al disclose the microwave popping of popcorn in a pouch which is, in turn, contained in a carton during the popping.

The package of this invention includes a paperboard carton which is compact and stable, preferably of rectangular configuration for compact bulk packaging and shelf display. Raw popcorn kernels are disposed along with appropriate fats and seasoning in a sealed plastic pouch which is folded in a particular manner and disposed in the carton. The carton has a top wall panel which includes a tear-away cover portion whereby an opening is created in the top wall panel when the cover portion is torn away therefrom. The top wall panel also includes constraining portions which frame at least a portion of the opening. When the opened package is placed in a microwave oven, the majority of the pouch is free to expand out of the carton through the opening while edge portions of the pouch which underlie the constraining portions of the top wall panel are forced up against the constraining portions by the expanding popcorn in those edge portions of the pouch so as to wedge those edges of the pouch against the constraining portions of the carton. The pouch is thus effectively locked into engagement with the carton and, yet, is still free to expand out of the carton through the opening. The carton is also preferably provided with feet which engage the floor of the microwave oven and elevate the bottom panel of the carton so as to eliminate or minimize scorching of the bottom panel of the carton when the corn is popped. The carton per se is of the general type disclosed in U.S. Pat. No. 3,004,697 issued Oct. 17, 1961 to O. W. Stone.

It is, therefore, an object of this invention to provide a package for microwave popping of popcorn in situ in the package.

It is a further object of this invention to provide a package of the character described which includes a sealed flexible pouch which contains popcorn kernels, fats and seasonings and which is folded and disposed inside of a compact stable paperboard carton.

It is an additional object of this invention to provide a package of the character described wherein the carton includes a removable portion in its top wall panel with pouch constraining portions disposed about the perimeter of the removable portion.

It is another object of this invention to provide a package of the character described wherein the pouch is free to expand during popping through an opening in the carton created by removal of the removable portion and wherein edges of the pouch are wedged against the constraining portions of the carton by expanding popcorn in the pouch to effectively lock the pouch to the carton during and after popping.

These and other objects and advantages of the invention will become more readily apparent from the following detailed description of a preferred embodiment of the invention when taken in conjunction with the accompanying drawings.

Figure 1:
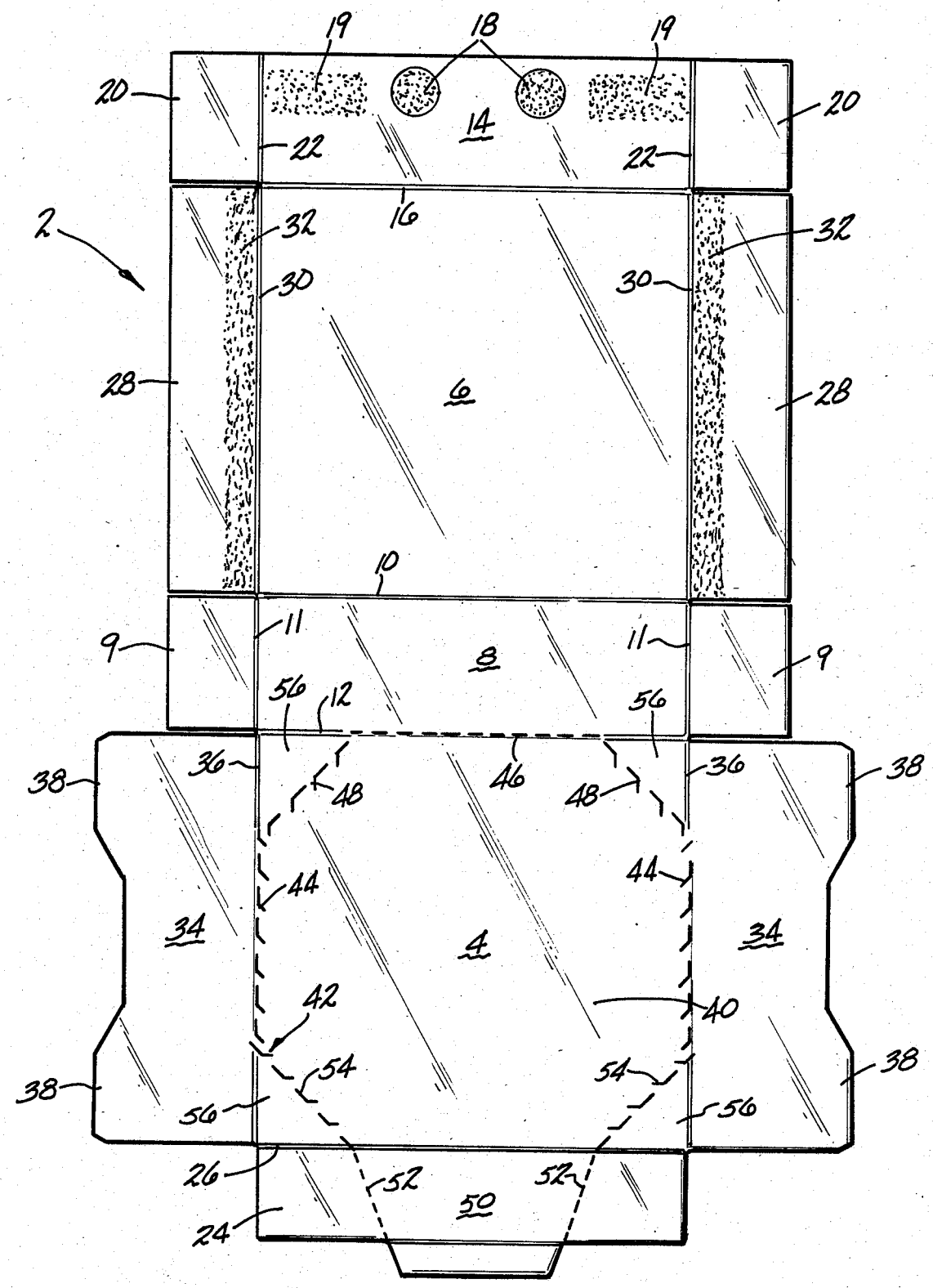
FIG. 1 is a plan view of a cut and scored paperboard blank adapted to be folded and glued into a preferred embodiment of the carton portion of the package of this invention.

Referring now to the drawings, there is shown in FIG. 1 a cut and scored paperboard blank, denoted generally by the numeral 2, which blank includes top and bottom wall panels 4 and 6 respectively. The bottom wall panel 6 is connected to a side wall panel 8 along a fold line 10, and the side wall panel 8 is connected to the top wall panel 4 along a fold line 12. Corner flaps 9 are foldably connected to the side wall panel 8 along fold lines 11. An inner side wall panel 14 is foldably connected to the bottom wall panel 6 by a fold line 16, the panel 14 being provided with a pair of adhesive spots 18 and adhesive strips 19. Corner flaps 20 are foldably connected to the side wall panel 14 along fold lines 22. An outer side wall panel 24 is foldably connected to the top wall 4 along a fold line 26. Inner end wall panels 28 are foldably connected to opposite end edges of the bottom wall panel 6 along fold lines 30. Each panel 28 is provided with an adhesive strip 32. Outer end wall panels 34 are connected to the top wall panel 4 along fold lines 36. Each outer end wall panel 34 is provided with a pair of panel extensions 38 which form feet for the carton 2 when the latter is erected. The top wall panel 4 has formed therein a central removable portion 40 which is bounded by a rupturable score line 42. The score line 42 has portions 44 which are colinear with the fold lines 36, and a portion 46 which is colinear with the fold line 12. Intermediate converging portions 48 interconnect proximal ends of the portions 44 and 46. A lift tab 50 extends from the removable portion 40 into the outer side wall panel 24 and is bounded by rupturable score lines 52. Converging rupturable scores 54 interconnect proximal ends of the score lines 52 and 44. The scores 48 combine with the fold lines 12 and 36 to define constraining portions 56, and the scores 54 combine with the fold lines 26 and 36 to define constraining portions 56 whereby there is a constraining portion 56 at each corner of the top wall panel 4.

Figure 2:
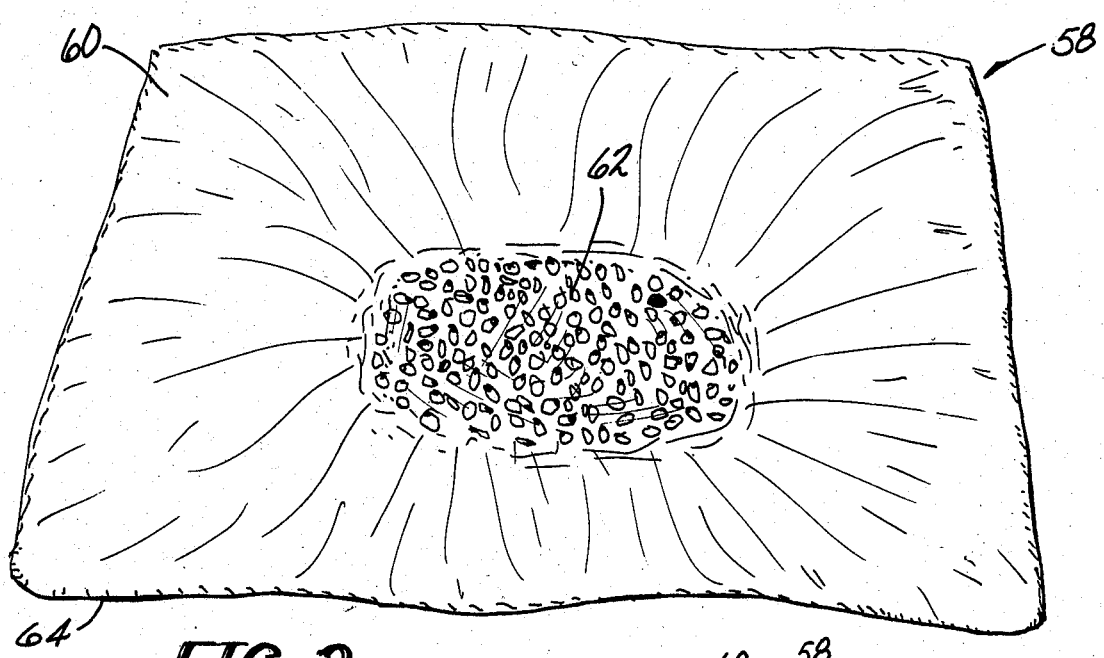
FIG. 2 is a perspective view of the flexible pouch portion of the package of this invention which contains the popcorn kernels, fats and seasonings.

Referring now to FIG. 2, there is shown a preferred embodiment of a flexible pouch, denoted generally by the numeral 58, adapted for use as a component of the package of this invention. The pouch 58 is formed from two preferably rectangular sheets 60 of flexible plastic such as polyethylene terephthalate which may be treated with a polyvinylidene chloride coating to improve its oxygen and moisture barrier properties. An appropriate amount of popcorn kernels 62, fats and seasonings is disposed in the pouch 58 between the sheets 60, and the edges 64 of the sheets 60 are sealed together with the pouch 58 being substantially devoid of air.

Figure 3:
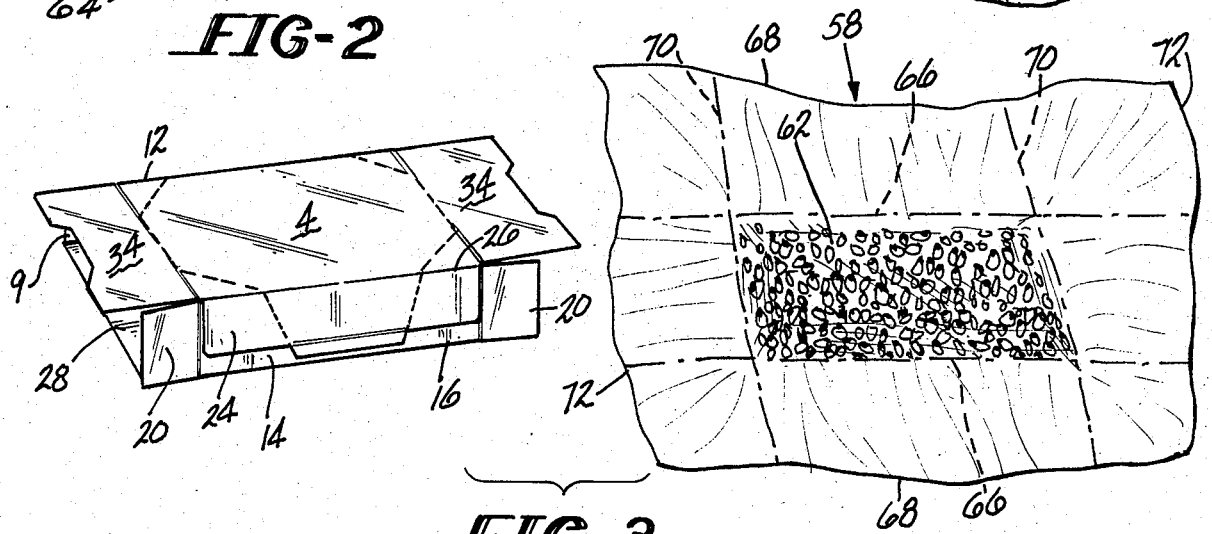
FIG. 3 is a perspective view of the partially erected, open-ended carton showing how the pouch is to be folded for insertion into the carton.
Figure 4:
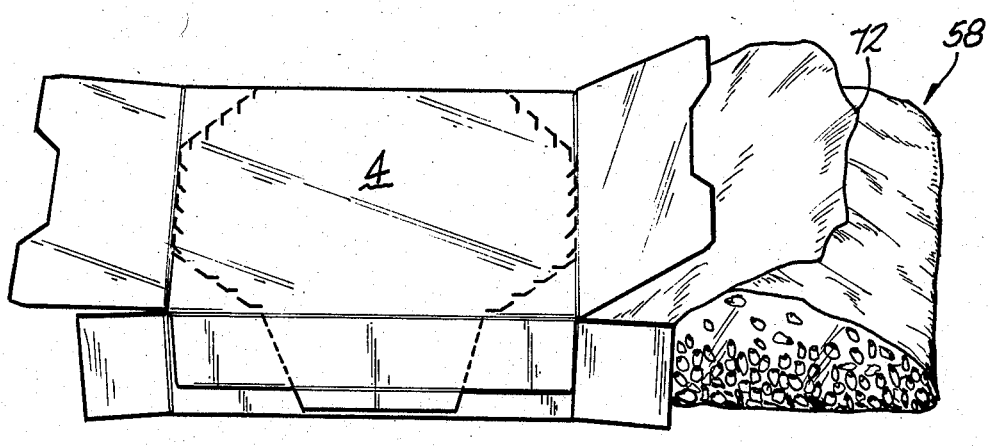
FIG. 4 is a perspective view of the carton and folded pouch as the latter is being inserted into the former.
Figure 5:
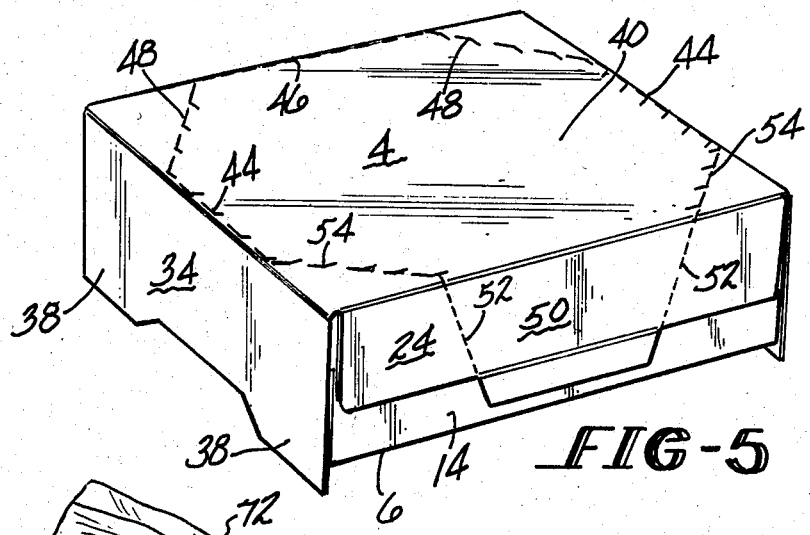
FIG. 5 is a perspective view of the filled, closed package.

Referring to FIGS. 3 and 4, the carton is shown in its partially erected, open-ended configuration which is derived by folding the blank about fold lines 10, 12, 16 and 26 so as to bring the outer side panel 24 into overlapping relationship with the inner side panel 14 whereupon the panels 14 and 24 are secured together by the adhesive spots 18 and adhesive strips 19. The panels 28 and 34 and the flaps 9 and 20 are left in coplanar relationship with the panels 4, 6, 8, 14 and 24 so as to provide open ends for the partially erected carton. The partially erected carton is oriented with its top wall 4 up, as shown in FIG. 3 and the filled pouch 58 is folded first about parallel fold lines 66 (shown in phantom) to bring the opposite edges 68 of the pouch 58 into overlapping relationship above the encased popcorn kernels 62. The partially folded pouch 58 is then folded about a second set of parallel fold lines 70 (shown in phantom) to bring the second pair of opposite edges 72 of the pouch 58 into overlapping relationship over the encased popcorn kernels 62. The configuration of the finally folded pouch 58 is shown in FIG. 4. The folded pouch 58 is then inserted into the carton through one of the open ends thereof so that the overlapped edges 72 of the pouch 58 directly underlie the top panel 4 of the carton and with a portion of the popcorn kernels being disposed in parts of the pouch positioned between the bottom wall and the top wall constraining portions such that popped pieces of popcorn within the pouch will operate to wedge parts of the pouch between the constraining portions of the carton top wall and corresponding portions of the bottom wall to lock the pouch to the carton. It will be noted that the folded pouch closely approximates the carton in size. After the pouch 58 has been inserted into the carton, the flaps 9 and 20 are folded inwardly about fold lines 11 and 22 respectively, the inner end wall panels 28 are folded upwardly about fold lines 30 and the outer end wall panels 34 are folded downwardly about fold lines 36 to overlie the panels 28. The outer panels 34 are then secured to the inner panels 28 by the adhesive strips 32 resulting in the closed package shown in FIG. 5. It will be noted that the extensions 38 on the outer end walls 34 project past the plane of the bottom wall 6 so that the latter will be elevated above any flat surface on which the package is disposed such as the floor of a microwave oven. This retards scorching of the bottom wall 6 of the package when the popcorn is popped in the package in a microwave oven. The projections or feet 38 do not, however, prevent the cartons from being stacked snugly on top of each other for bulk packing or display, and in fact, the springiness of the feet 38 tends to hold the packages together in a vertical stack.

Figure 6:
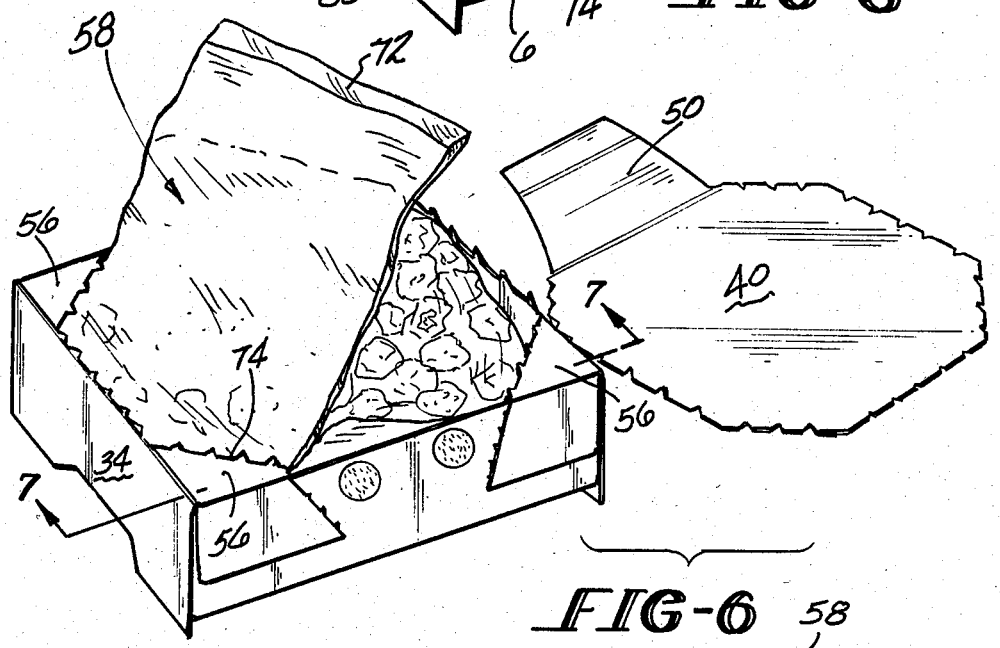
FIG. 6 is a perspective view of the package after the removable portion has been removed from the top wall panel of the carton and the corn has begun to pop causing the pouch to expand out of the carton through the opening therein found by removal of the removable portion.
Figure 7:
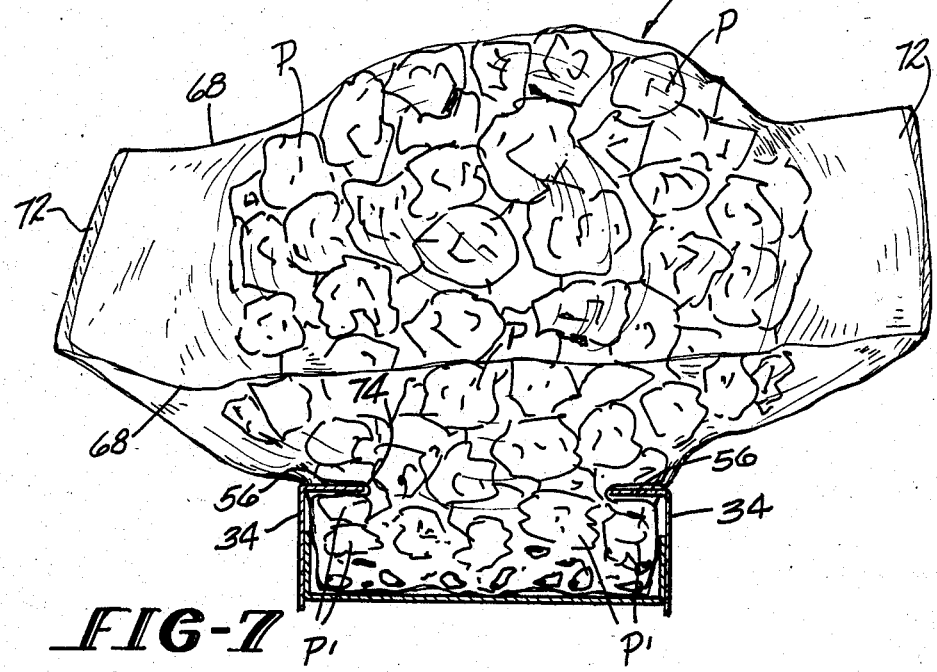
FIG. 7 is a side elevational sectional view taken along line 7—7 of FIG. 6 showing the wedging of the pouch beneath the constraining portions of the carton as the popcorn continues to pop and the pouch continues to expand out of the carton.

To pop the corn in the package in a microwave oven, the tab 50 is grasped and pulled up to cause the score lines 52, 54, 44, 48 and 46 to rupture whereby the removable portion 40 of the top panel 4 is detached from the rest of the package, as shown in FIG. 6. Thus an opening 74 is formed in the top wall of the carton, which opening is at least partially framed by the constraining portions 56. Due to the approximate size conformity of the folded pouch 58 and carton, portions of the folded pouch 58 underlie the constraining portions 56 and are wedged there against due to the bulk of the folded pouch 58. When the opened package is placed in a microwave oven to pop the corn, the popping results in the production of steam internally of the sealed pouch 58 which causes the latter to inflate. This, in turn, pushes the edges 72 and 68 out of the carton through the opening 74 as the volume of the pouch 58 increases. As shown in FIG. 7, the popped pieces of corn P fill the expanded pouch 58 and the edges 72 and 68 of the pouch 58 are pushed outside of the carton through the opening 74. Some of the popped pieces of corn identified as P′ are trapped beneath the constraining portions 56 of the carton and wedge a part of the pouch 58 tightly against the end walls 34 and the constraining portions 56 of the carton whereby the pouch 58 is locked to the carton. Popping continues with the kernels in the central part of the mass being free to migrate through the opening 74 into the expanded portion of the pouch 58 which lies outside of the carton. It will be noted that the wedging popcorn pieces P′ will be located at the edges of the kernel mass disposed in the pouch 58. The carton thus serves as a base for the expanded pouch.

It will be appreciated that the package of this invention is compact and stable and can be easily packed in bulk amounts or readily displayed at point of sale. Provision is made for in situ popping of the popcorn kernels with the pouch being allowed to expand out of the carton and yet remain locked to the carton by means of the expanded pieces of popped corn wedging the pouch against portions of the carton. The expansion and locking of the pouch are concurrently achieved by properly folding the pouch and properly orienting the folded pouch in the carton.

Since many changes and variations of the disclosed embodiment of the invention may be made without departing from the inventive concept, it is not intended to limit the invention otherwise than as required by the appended claims.

What is claimed is:

1. A package for in situ microwave popping of popcorn, said package comprising:

(a) a paperboard carton comprising a top wall, a bottom wall, and side and end walls foldably interconnecting said top and bottom walls, said top and bottom walls being parallel to each other;

(b) said top wall including a removable portion formed therein, and a plurality of constraining portions in said top wall with said constraining portions at least partially bounding said removable portion, whereby removal of said removable portion from said carton is operable to form an opening in said top wall which opening is at least partially bounded by said constraining portions; and (c) a sealed flexible pouch containing popcorn kernels to be popped in said package, said kernels being substantially centrally located in said pouch, said pouch being disposed in said carton in a folded condition wherein a first pair of opposed edges of said pouch are folded into overlapping relationship with each other above the enclosed popcorn kernels and a second pair of opposed edges of said pouch are folded into overlapping relationship with each other above said first pair and said enclosed popcorn kernels so as to impart to said folded pouch a size which closely conforms to the size of said carton, said pouch being disposed in said carton with said second pair of overlapping edges of said pouch being disposed immediately inwardly of said removable portion of said carton and with a portion of said popcorn kernels being disposed in parts of said pouch positioned between said bottom wall and said top wall constraining portions sufficient such that popped pieces of popcorn within said pouch will operate to wedge said parts of said pouch between said constraining portions of said carton top wall and corresponding portions of said bottom wall to lock said pouch to said carton while said overlapping edges of said pouch are free to move outwardly of said carton through said opening to expand the pouch to receive popped kernels of the popcorn.

2. The package of claim 1 wherein an opposed pair of said side and end walls include extended portions projecting past the plane of said bottom wall to elevate said bottom wall with respect to a planar surface on which said package is positioned.

3. The package of claim 1 wherein said removable portion of said carton top wall is defined by a plurality of rupturable score lines, at least some of which are interposed between said removable portion and said constraining portions.

4. The package of claim 1 wherein said carton is rectangular in configuration.

5. The package of claim 4 wherein said constraining portions are disposed at corners of said carton top wall.

* * * * *